US006572336B2

(12) United States Patent
Horng et al.

(10) Patent No.: US 6,572,336 B2
(45) Date of Patent: Jun. 3, 2003

(54) IMPELLER STRUCTURE

(75) Inventors: Alex Horng, Kaohsiung (TW); Ching-Shen Hong, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 09/964,345

(22) Filed: Sep. 28, 2001

(65) Prior Publication Data

US 2003/0063975 A1 Apr. 3, 2003

(51) Int. Cl.[7] ..... F04D 29/38
(52) U.S. Cl. ..... 416/183; 416/203; 416/212 R
(58) Field of Search ..... 416/183, 175, 416/203, 212 R, 214 R, 198 R, 200 R, 207

(56) References Cited

U.S. PATENT DOCUMENTS 6,318,964 B1 * 11/2001 Yang ..... 416/185

* cited by examiner

*Primary Examiner*—Edward K. Look
*Assistant Examiner*—Dwayne J. White
(74) *Attorney, Agent, or Firm*—Bacon & Thomas, PLLC

(57) ABSTRACT

An impeller structure includes a hub body having one end provided with a top plane which is provided with a central shaft. The hub body has a periphery provided with a plurality of blades. The other end of the hub body is provided with a joint portion that may be combined and secured with the extension hub which has a plurality of blades.

8 Claims, 6 Drawing Sheets

IMPELLER STRUCTURE

BACKGROUND OF THE INVENTION

1. Field of the Invention

The present invention relates to an impeller structure, and more particularly to an impeller structure that may be made easily and may have more blades, so that the impeller has a larger blade driving face, thereby increasing the air flow rate driven by the blades.

2. Description of the Related Art

A conventional axial flow type impeller 90 in accordance with the prior art as shown in FIGS. 1 and 2 comprises a hub 91 provided with a central shaft 92 that may be pivoted to rotate. The hub 91 is provided with a plurality of blades 93. When the impeller 90 is rotated, the blades 93 may drive the air to flow. The conventional axial flow type impeller 90 is made of a plastic material. After the impeller ha been formed in the die, it is stripped from the die. Thus, the head and tail ends 93*a* and 93*b* of two adjacent blades 93 have to be located at the two sides of the stripping line That is, the head and tail ends 93*a* and 93*b* of any two adjacent blades 93 cannot cross the stripping line to overlap each other. The air flow rate driven by the impeller is positively proportional to the area of the blade 93 that drives the air flow. Thus, if the area of the blade 93 is to be increased, the diameter of the hub 91 has to be increased correspondingly. However, after the conventional axial flow type impeller 90 is formed in the die, it is limited by the stripping restriction. Thus, the driving area of the blade 93 cannot be increased to increase the air flow rate driven by the impeller without increasing the diameter of the hub 91.

SUMMARY OF THE INVENTION

The primary objective of the present invention is to provide an impeller structure that may increase the blade area for driving the air flow without increasing the diameter of the hub, thereby increasing the air flow rate driven by the impeller. In addition, the impeller structure may be made easily.

In accordance with the present invention, there is provided an impeller structure including a hub body having one end provided with a top plane which is provided with a central shaft. The hub body has a periphery provided with a plurality of blades. The other end of the hub body is provided with a joint portion that may be combined and secured with the extension hub which has a plurality of blades.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
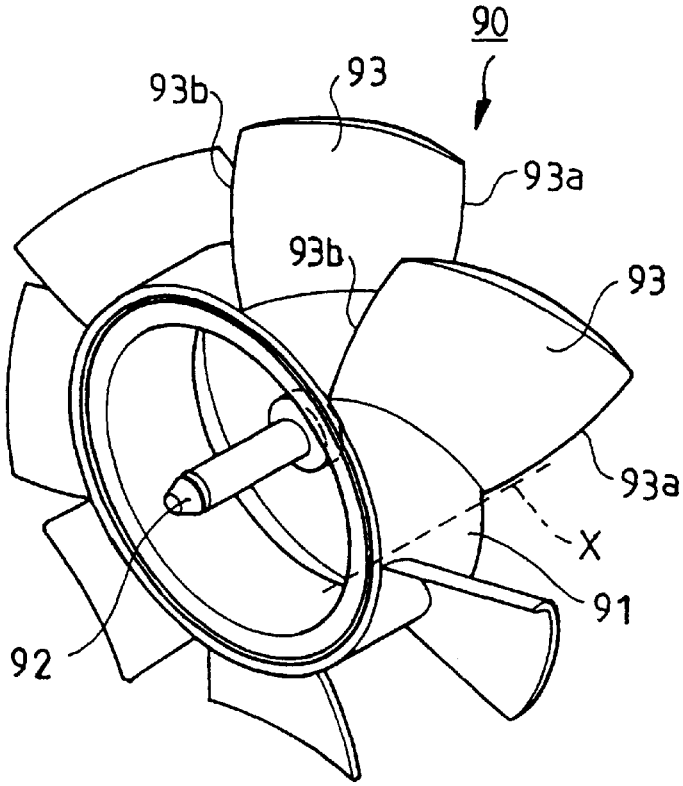
FIG.1 PRIOR ART
FIG. 1 is a perspective view of a conventional impeller in accordance with the prior art.
Figure 2:
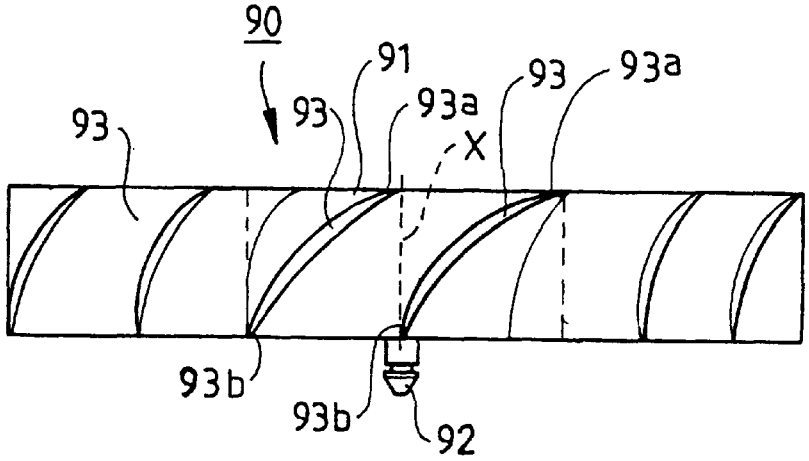
FIG.2 PRIOR ART
FIG. 2 is a front plan view of the conventional impeller as shown in FIG. 1.
Figure 3:
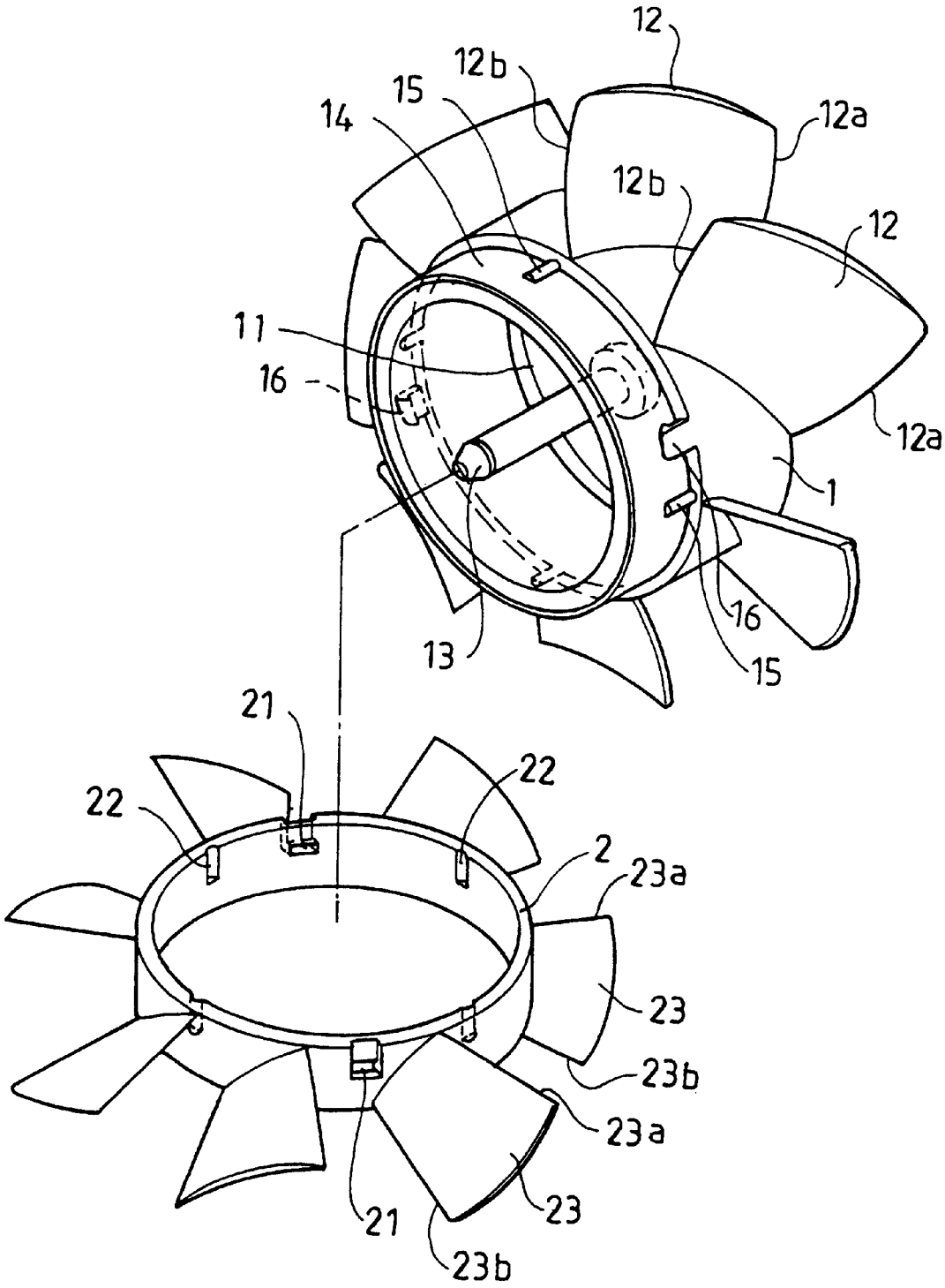
FIG. 3 is an exploded perspective view of an impeller structure in accordance with a first embodiment of the present invention.

Referring to the drawings and initially to FIG. 3, an impeller in accordance with a first embodiment of the present invention comprises a hub body 1, and an extension hub 2.

The hub body 1 has one end provided with a top plane 11 which is provided with a central shaft 13. The impeller may be supported by the central shaft 13 to pivot and rotate. The hub body 1 has a periphery provided with a plurality of blades 12 each having a first end 12*a* and a second end 12*b*. The first end 12*a* and the second end 12*b* of any two adjacent blades 12 are located at the two sides of the stripping line of the forming die respectively. That is, the first end 12*a* and the second end 12*b* of any two adjacent blades 12 do not cross the stripping line The other end of the hub body 1 is provided with a joint portion 14 that may be combined and secured with the extension hub 2 in the conventional bonding (by an adhesive), screwing or the like manner. The joint portion 14 may be provided with multiple barbs 16 to be combined with the extension hub 2 in snapping manner. The joint portion 14 of the hub body 1 may be provided with a plurality of positioning members 15. Each positioning member 15 may be a lug or a recess, so that the hub body 1 and the extension hub 2 may have a better positioning effect after combination.

The extension hub 2 may be combined on the joint portion 14 of the hub body 1 in the conventional bonding (by an adhesive), screwing or the like manner. The extension hub 2 may be provided with multiple snap holes 22 to combine with the barbs 16 of the hub body 1 in a snapping manner. The extension hub 2 may be provided with a plurality of positioning members 22 that may be locked and positioned with the positioning members 15 of the hub body 1. Each positioning member 22 may be a lug or a recess, so that the hub body 1 and the extension hub 2 may have a better positioning effect after combination (see FIG. 6). The extension hub 2 has a periphery provided with a plurality of blades 23. The number of the blade 23 of the extension hub 2 may be the same as or different from that of the blade 12 of the hub body 1. Each blade 23 has a first end 23*a* and a second end 23*b*. The first end 23*a* of the blade 23 of the extension hub 2 may align with the second end 12*b* of the blade 12 of the hub body 1 as shown in FIG. 5.

Figure 4:
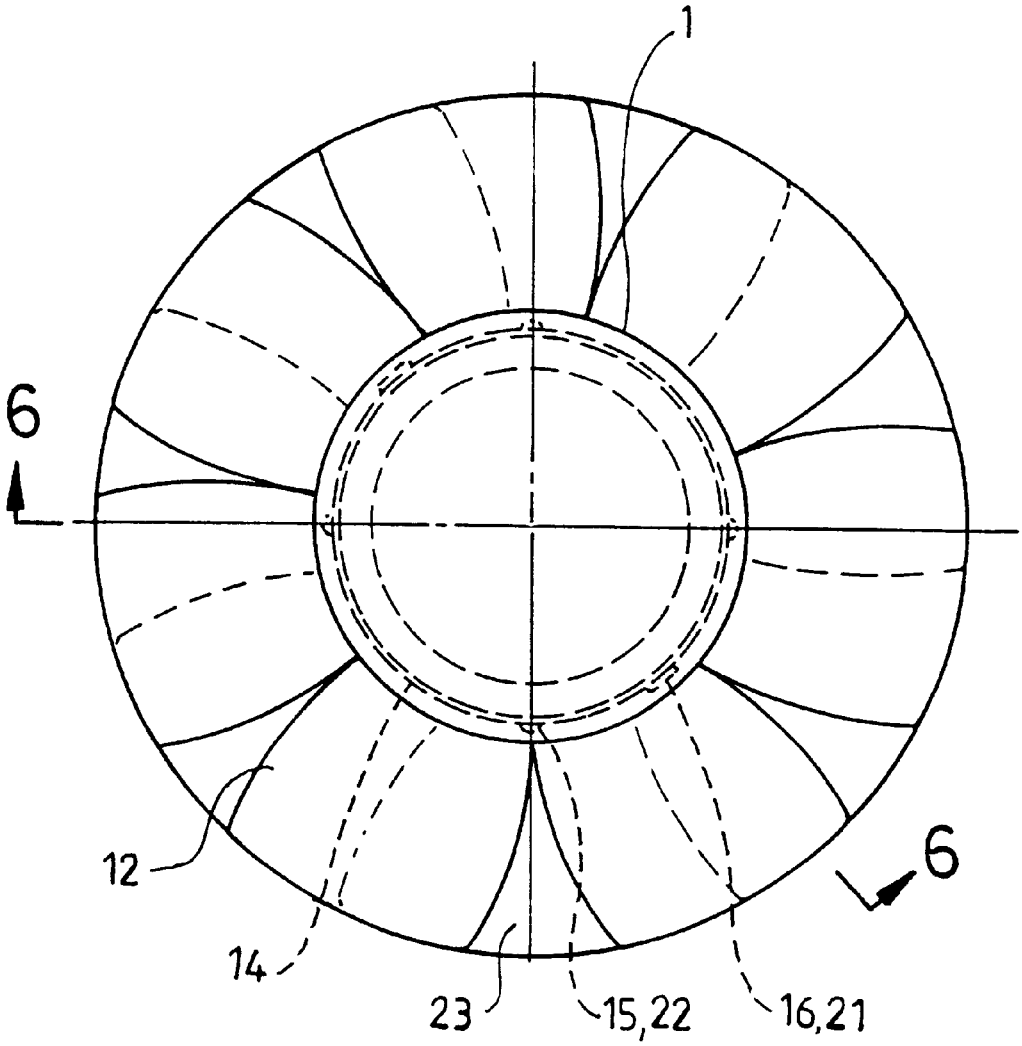
FIG. 4 is a top plan assembly view of the impeller structure as shown in FIG. 3.
Figure 5:
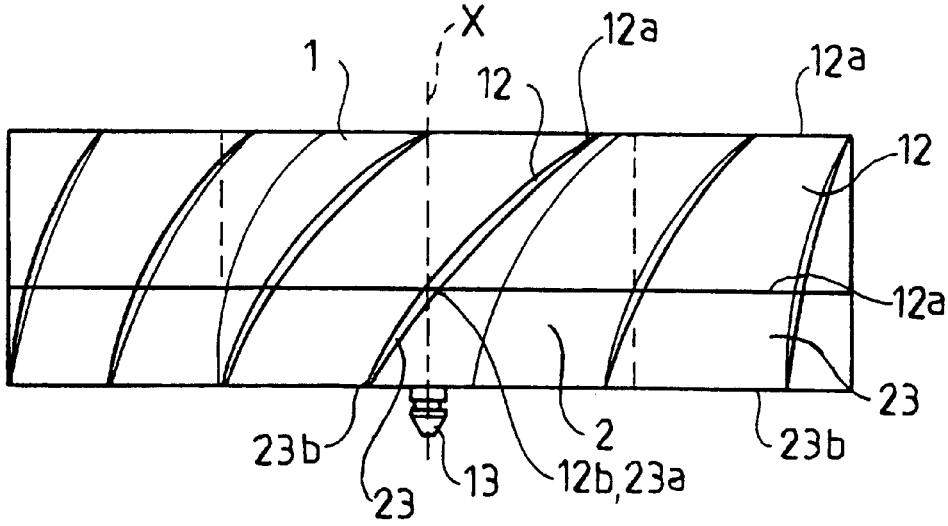
FIG. 5 is a front plan assembly view of the impeller structure as shown in FIG. 3.
Figure 6:
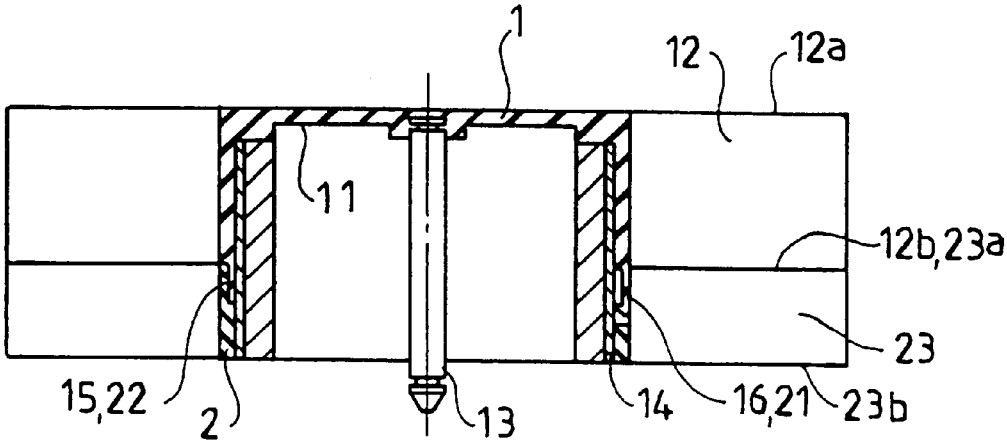
FIG. 6 is a cross-sectional view of the impeller structure along line 6—6 as shown in FIG. 4.

Referring to FIGS. 4–6, the combination situation of the present invention is shown. The extension hub 2 is combined on the joint portion 14 of the hub body 1, and the first end 23*a* of the blade 23 of the extension hub 2 may align with the second end 12*b* of the blade 12 of the hub body 1. Thus, for the impeller, the diameter of the hub body 1 is not changed, and the impeller has a larger blade area. Especially, after the first end 23*a* of the blade 23 of the extension hub 2 is connected with the second end 12*b* of the blade 12 of the hub body 1, the blade 23 will cross the stripping line of the hub body 1. Thus, the blades 12 and 23 of the impeller will have a larger area to drive the air flow, thereby enhancing the air flow driving effect of the impeller.

Figure 7:
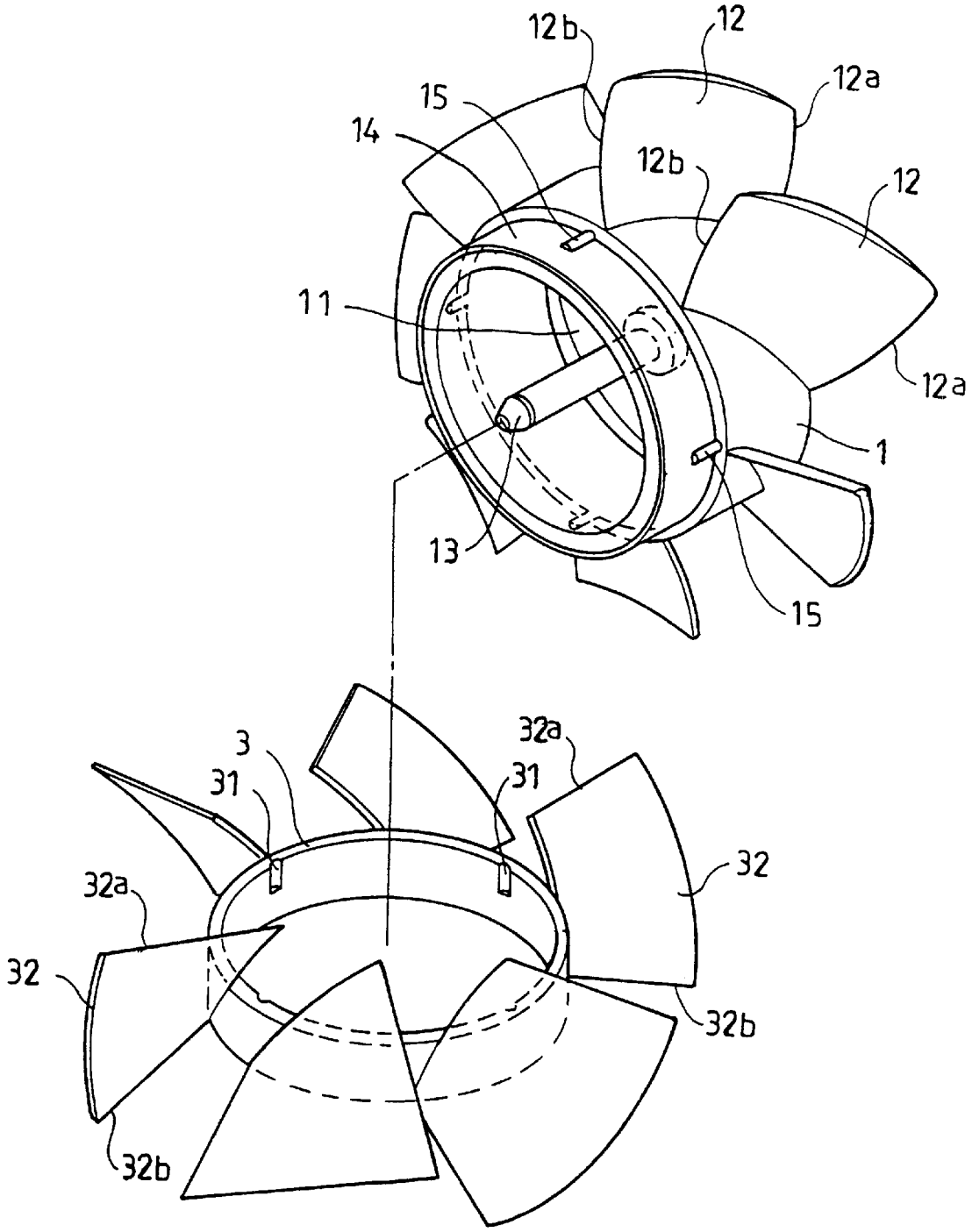
FIG. 7 is an exploded perspective view of an impeller structure in accordance with a second embodiment of the present invention.
Figure 8:
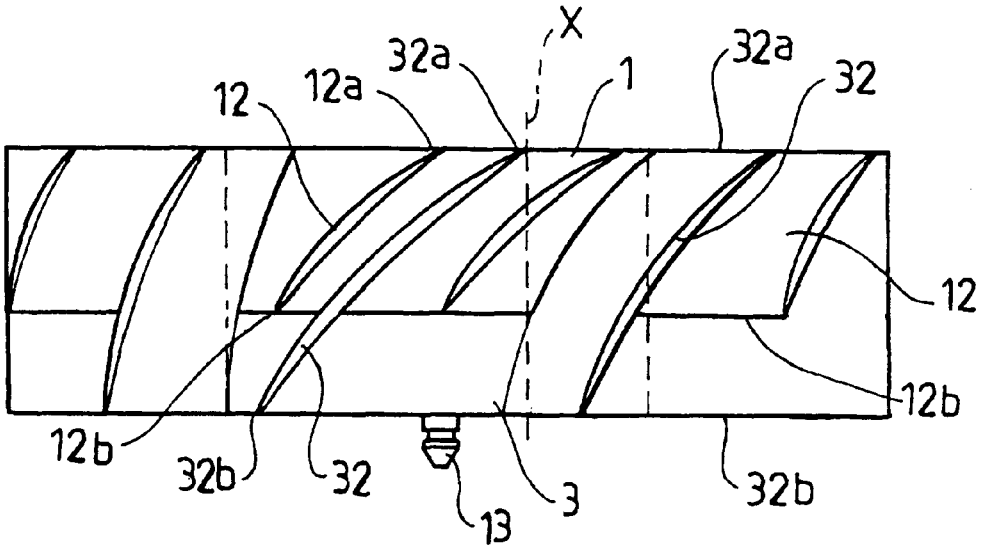
FIG. 8 is a front plan assembly view of the impeller structure as shown in FIG. 7.

Referring now to FIG. 7, the impeller in accordance with a second embodiment of the present invention comprises a hub body 1, and an extension hub 3. The hub body 1 is the same as that of the first embodiment. The extension hub 3 may be combined on the joint portion 14 of the hub body 1. The extension hub 3 may be provided with a plurality of positioning members 31 that may be locked and positioned with the positioning members 15 of the hub body 1. The extension hub 3 has a periphery provided with a plurality of blades 32. The number of the blade 32 of the extension hub 3 may be the same as or different from that of the blade 12 of the hub body 1. Each of the blades 32 has a first end 32*a* and a second end 32*b*. In the preferred embodiment, the first end 32*a* of the blade 32 of the extension hub 3 protrudes from the body of the extension hub 3, and is aligned between the first ends 12*a* of two adjacent blades 12 of the hub body 1, so that the blade 32 may extend between the two adjacent blades 12 of the hub body 1 as shown in FIG. 8. Thus, the impeller may have a larger blade area.

Accordingly, the impeller structure in accordance with the present invention may increase the blade area without increasing the diameter of the hub, thereby relatively increasing the air flow driving area of the blade of the impeller, so as to achieve the effect of increasing the air flow rate driven by the impeller.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An impeller structure, comprising:

a hub body, having a central shaft, and having a periphery provided with a plurality of blades, said hub body provided with a joint portion; and an extension hub, combined on said joint portion of said hub body, said extension hub having a plurality of blades, wherein each blade of said extension hub has one end respectively aligned with one end of each blade of said hub body.

2. The impeller structure as claimed in claim 1, wherein a number of said blades of said extension hub is the same as that of said blades of said hub body.

3. The impeller structure as claimed in claim 2, wherein each blade of said extension hub has one end respectively aligns with one end of each blade of said hub body.

4. The impeller structure as claimed in claim 1, wherein said extension hub and said hub body are respectively provided with positioning members, so that said extension hub and said hub body are positioned mutually after combination.

5. The impeller structure as claimed in claim 4, wherein each of said positioning members is a lug or a recess.

6. The impeller structure as claimed in claim 1, wherein said extension hub is combined with said hub body by an adhesive.

7. An impeller structure, comprising:

a hub body, having a central shaft, and having a periphery provided with a plurality of blades, said hub body provided with a joint portion; and an extension hub, combined on said joint portion of said hub body, said extension hub having a plurality of blades, wherein a number of said blades of said extension hub is different from that of said blades of said hub body.

8. An impeller structure, comprising:

a hub body, having a central shaft, and having a periphery provided with a plurality of blades, said hub body provided with a joint portion; and an extension hub, combined on said joint portion of said hub body, said extension hub having a plurality of blades, wherein said extension hub and said hub body are respectively provided with barbs and snap holes, and said barbs and said snap holes are snapped with each other, so that said extension hub is combined with said hub body.

* * * * *